US005807029A

United States Patent [19]

Ellnor

[11] Patent Number: 5,807,029

[45] Date of Patent: Sep. 15, 1998

[54] OFFSHORE CONSTRUCTION AND VESSEL

[75] Inventor: Piet Ellnor, East Fremantle, Australia

[73] Assignee: Cherwora Pty. Ltd., Daglish, Australia

[21] Appl. No.: 750,221

[22] PCT Filed: Jun. 7, 1995

[86] PCT No.: PCT/AU95/00336

§ 371 Date: Dec. 4, 1996

§ 102(e) Date: Dec. 4, 1996

[87] PCT Pub. No.: WO95/33892

PCT Pub. Date: Dec. 14, 1995

[30] Foreign Application Priority Data

Jun. 8, 1994 [AU] Australia ..... PM6146
Nov. 28, 1994 [AU] Australia ..... PM9708

[51] Int. Cl.[6] ..... E02D 25/00

[52] U.S. Cl. ..... 405/204; 405/203; 405/209; 114/258

[58] Field of Search ..... 405/203, 204, 405/205, 206, 207, 209; 114/258, 259, 201 R, 202; 212/177, 179

[56] References Cited

U.S. PATENT DOCUMENTS

| | | | |
|---|---|---|---|
| 3,054,267 | 9/1962 | Alcorn et al. | 405/209 |
| 3,785,322 | 1/1974 | Kersteter | 114/201 R |
| 3,874,180 | 4/1975 | Sumner | 114/259 |
| 3,982,634 | 9/1976 | Miyazaki | 212/179 |
| 4,109,477 | 8/1978 | Vogel | 405/207 |
| 4,669,917 | 6/1987 | Sveen | 405/204 X |
| 4,683,832 | 8/1987 | Dysarz | 405/209 X |
| 4,690,586 | 9/1987 | Oksuzler | 405/209 |
| 4,825,791 | 5/1989 | Foster, Jr. et al. | 405/203 X |
| 4,927,296 | 5/1990 | Kaldenbach | 405/206 |
| 5,195,445 | 3/1993 | Riddles et al. | 114/201 R |
| 5,253,605 | 10/1993 | Collins | 114/258 X |

FOREIGN PATENT DOCUMENTS

| | | | |
|---|---|---|---|
| 1108890 | 6/1961 | Germany . | |
| 1254666 | 11/1967 | Germany . | |
| 1658910 | 11/1970 | Germany . | |
| 2527128 | 12/1976 | Germany . | |
| 2918781 | 7/1980 | Germany . | |
| 242226 | 10/1986 | Japan | 405/209 |
| 353829 | 2/1990 | Netherlands | 114/258 |
| 590 369 | 8/1977 | Switzerland . | |
| 1528861 | 12/1989 | U.S.S.R. . | |
| 90/03470 | 4/1990 | WIPO . | |
| 92/08849 | 5/1992 | WIPO . | |

*Primary Examiner*—Tamara L. Graysay
*Assistant Examiner*—Jong-Suk Lee
*Attorney, Agent, or Firm*—McCormick, Paulding & Huber

[57] ABSTRACT

A construction jack-up barge comprising a barge (11) supporting a tower (13) in a stowed horizontal position for transport and a vertical position for deployment. The tower (13) has three fold-out legs (15), each equipped with a footing assembly (17). The tower (13) is supported for rotation between a horizontal stowed position and a vertical position for deployment, about the barge (11), by a pivotal connection (19). The tower is also supported in a traveling frame (20) which has concave shaped rollers (21) which track each chord of the tower (13), allowing the tower (13) to be moved up and down relative to the barge (11), when the tower is being deployed. In the vertical position the tower (13) is received through an opening which extends through the deck to the hull of the barge (11). A central cut out portion (33) extends from the stern of the barge (11), to the opening, to provide a pathway for the tower (13) as it rotates between the horizontal and vertical positions. The barge may be jacked up clear of the water, and may be separated from the column to enable the embarking therefrom.

25 Claims, 20 Drawing Sheets

83
82
85

76
80
81
77
15
76
22a
22b
22c 76
77
80a
79

OFFSHORE CONSTRUCTION AND VESSEL

FIELD OF THE INVENTION

This invention relates to the field of offshore constructions such as platforms, which are located usually above sea level, supported from the sea bed from columns, towers or pylons.

BACKGROUND OF THE INVENTION

Typical offshore platforms comprise a plurality of towers supported vertically in a barge, for towing to or self propelled navigation to the position of deployment, whereupon the towers are lowered vertically until they reach the sea bed. Subsequently the barge, which is to serve as a platform or the like, is jacked up the towers, clear of the surface of the sea.

SUMMARY OF THE INVENTION

In accordance with one aspect of the present invention there is provided a jack-up construction comprising a column and a vessel, said column being supportable on said vessel in a substantially horizontal position for storage or transport, and supportable in relation to said vessel in a substantially vertical position for deployment or use, wherein said construction includes a support structure for supporting said column for rotation between said horizontal position and said vertical position, and wherein said support structure includes an element which selectively allows for said vessel and said column to be disconnected to enable said vessel to embark from and dock to said column.

Preferably said support structure includes a pivotal connection extending between said column and said vessel. In this manner, the pivotal connection provides for rotation of the column relative to the vessel.

Preferably said element comprises a pivoting portion on said carriage which in a closed condition secures said column for sliding movement, and restrains said column in said vertical position.

Alternatively said pivotal connection is dismountable from said column and said carriage to enable said vessel and said column to be disconnected. With such a configuration, it would be necessary to secure said column against sliding, relative to said column, when said vessel is detached.

Preferably said jack-up construction includes hoisting means to move said column vertically, relative to said vessel, when said column is in said vertical position.

In accordance with a second aspect of the invention there is provided a vessel adapted for deployment as an offshore structure supported above the sea floor, said vessel including a support structure for supporting a column for rotation between a substantially horizontal stowed position and a vertical position for deployment, said support structure including an element allowing for said vessel and said column to be connected to enable said vessel to dock to said column, and disconnected to enable said vessel to embark from said column.

Preferably said support structure includes a pivotal connection point for forming a pivotal connection between said column and said vessel.

Preferably said support structure includes a carriage for supporting said column for selective sliding movement in relation thereto. In this manner, the column slides relative to the carriage as the vessel is jacked up or down the column.

Preferably said carriage includes flanged wheels or concave shaped pulleys for guiding said column.

Preferably said pivotal connection extends between said carriage and said vessel.

Preferably said carriage is dismountable from said column to enable said vessel and said column to be disconnected.

Preferably said carriage includes guide means for guiding vertical displacement of said vessel relative to said column.

Preferably said element comprises a pivoting portion on said carriage which in a closed condition secures said column for sliding movement, and restrains said column in said vertical position.

Alternatively said pivotal connection is adapted to be selectively connectable to connect/disconnect said vessel and said column.

Preferably said vessel includes hoisting means for moving said column vertically relative to said vessel, when said vessel is attached to said column and when said column is in said vertical position.

Preferably said vessel includes an opening extending vertically through the hull and deck of said vessel, through which said column is received in said vertical position.

Preferably said opening includes a recess along the edge of said vessel.

Preferably said opening is located away from the edge of said vessel, and said recess provides access from the edge of said vessel to said opening.

Preferably said opening is located at a relative central position in said vessel.

Preferably said recess extends to the stern of said vessel.

Preferably said vessel includes cover means for covering said recess when access thereto is not required.

Preferably said cover means comprises removable cover portions.

Preferably said vessel includes floodable compartments to allow balancing of the weight distribution of said vessel, relative to said column.

Preferably said vessel supports cranes for loading and unloading equipment. The cranes may be pedestal mounted or gantry mounted cranes as required.

In accordance with a third aspect of the invention there is provided a column for supporting a vessel and adapted for deployment as an offshore structure supported above the sea floor, said column having a support structure for selectively attaching to said vessel to allow said vessel to dock to or embark from said column, said support structure including a pivotal connection point for forming a pivotal connection between said column and said vessel when said column and said vessel are attached to allow said column to be rotated relative to said vessel from a horizontal stowed position to a vertical position for deployment.

Preferably said supporting means includes a carriage adapted to traverse said column, and which may be fixed to said column as required.

Preferably said column is adapted to be hoisted vertically up or down relative to said vessel when said pivotal connection is disconnected.

Preferably said column includes a weight distribution structure at the lowermost end thereof.

Preferably said weight distribution structure comprises at least three fold out legs.

Preferably each of said fold out legs includes a footing.

Preferably said footing includes a floodable chamber.

Preferably said footing comprises a sealable enclosure formed by an upper cup and a lower cup arranged one inside the other in telescoping alignment and defining a pressurable chamber therein, said pressurable chamber having inlet/outlet means for transfer of fluid in or out of said chamber.

Preferably said footing includes an axial guide assembly for alignment of the cups relative to each other.

Preferably said axial guide assembly includes a pair of members arranged to telescope along an axis co-parallel with the axial extent of said footing.

Preferably said cups are cylindrical.

Preferably said axis is coincident with the axial extent of said footing.

Preferably said members are tubular.

Preferably said members include a locking device to secure said members relative to each other.

Preferably said locking device comprises a wedge driveable into an annular collar located at the junction of said members.

Preferably said wedge is slidable along the inner member of said telescoping member and comprises a frustum bored along the axis thereof.

Alternatively, said locking device comprises a grout injection system adapted to in ject a settable grout composition to lock said members.

BRIEF DESCRIPTION OF THE DRAWINGS

The invention will now be described in the following description of one specific embodiment thereof, in which.

DETAILED DESCRIPTION OF THE PREFERRED EMBODIMENTS

The embodiment is directed towards a construction jack-up barge assembly for transporting and erecting an offshore tower for supporting a platform or the like.

Figure 1:
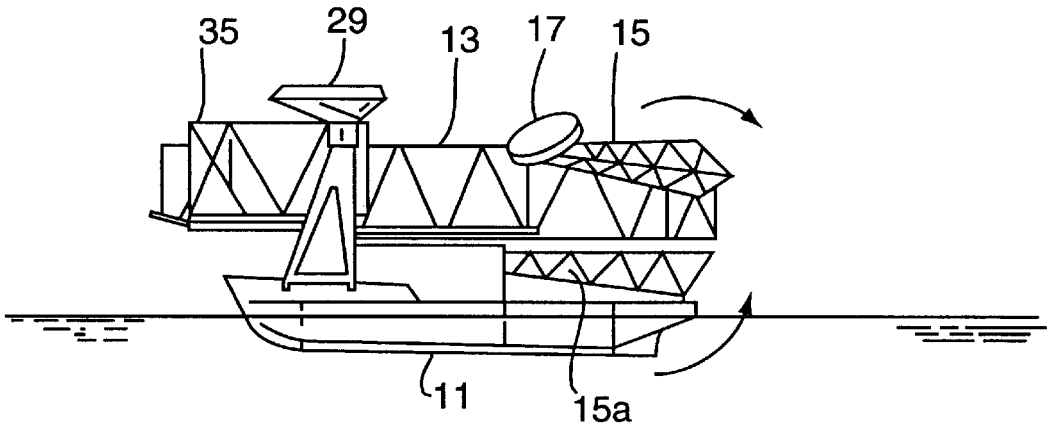
FIG. 1 is a side view of an offshore construction jack-up barge having a column shown in the stowed condition.
Figure 5:
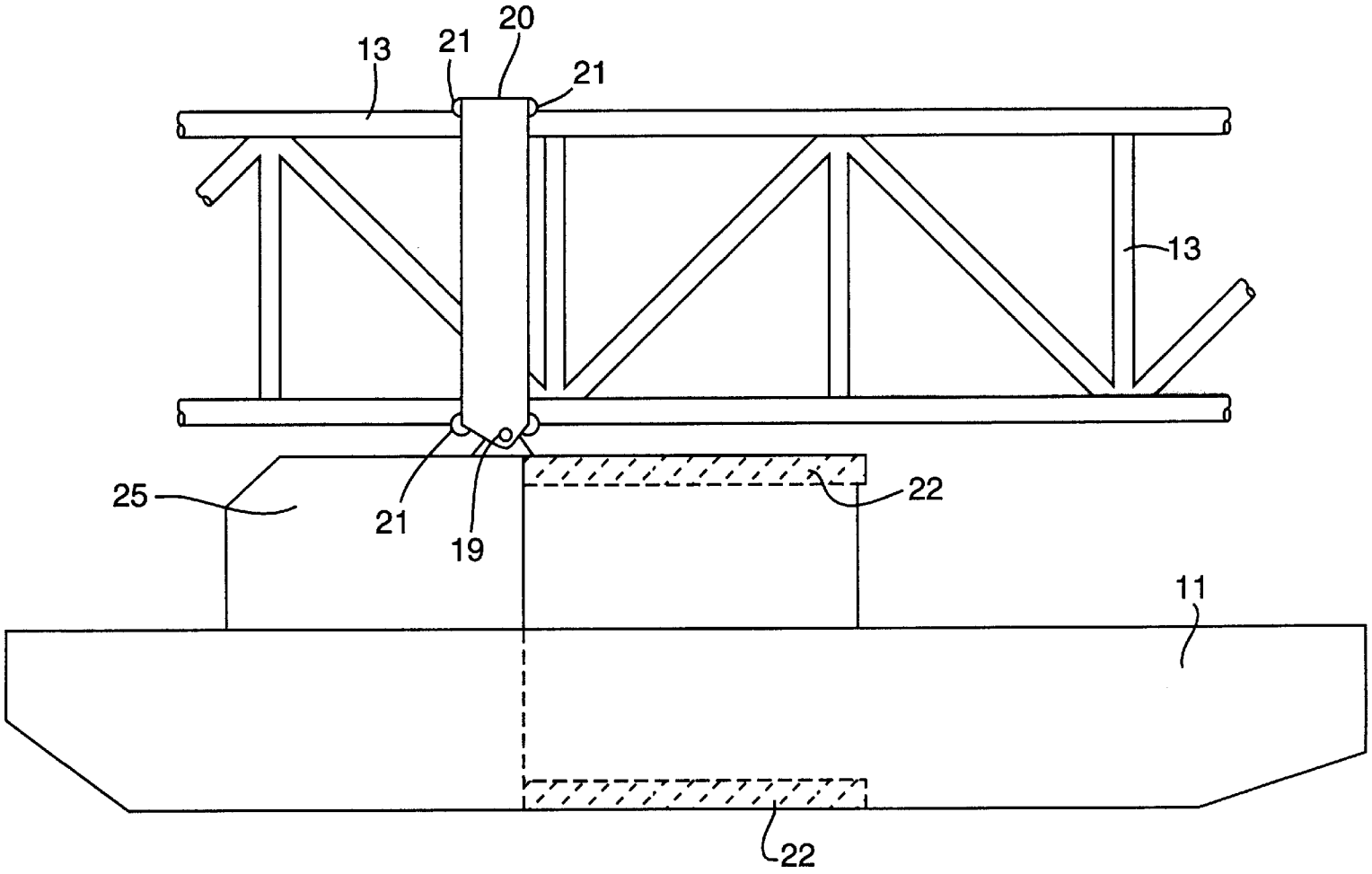
FIG. 5 is a side view of the construction jack-up barge with the column in the horizontal (stowed) position, showing the pivotal connection between the barge and the column.

The construction jack-up barge comprises a vessel in the form of a barge 11 supporting a column in the form of a large chord square section tower 13. The tower 13 has a weight distribution structure in the form of three fold out legs 15, each equipped with a footing assembly 17. The legs 15 are folded along the tower 13, in a retracted position, in which the tower assembly may be transported on the barge 11, as shown in FIG. 1. Referring to FIG. 5, the tower 13 is supported for rotation between a horizontal stowed position and a vertical position for deployment, about the barge 11, by a pivotal connection 19. The pivotal connection 19 is achieved by a pin and clevis arrangement secured to a carriage in the form of a travelling frame 20 which has concave shaped rollers 21 which track each chord of the tower 13. The carriage and pivotal connection 19 form a support structure for the tower 13. The construction jack-up barge may conveniently include suitable means for securing the tower 13 in the horizontal stowed position, to prevent damage in transit, in the event of rough seas or swell.

Figure 6:
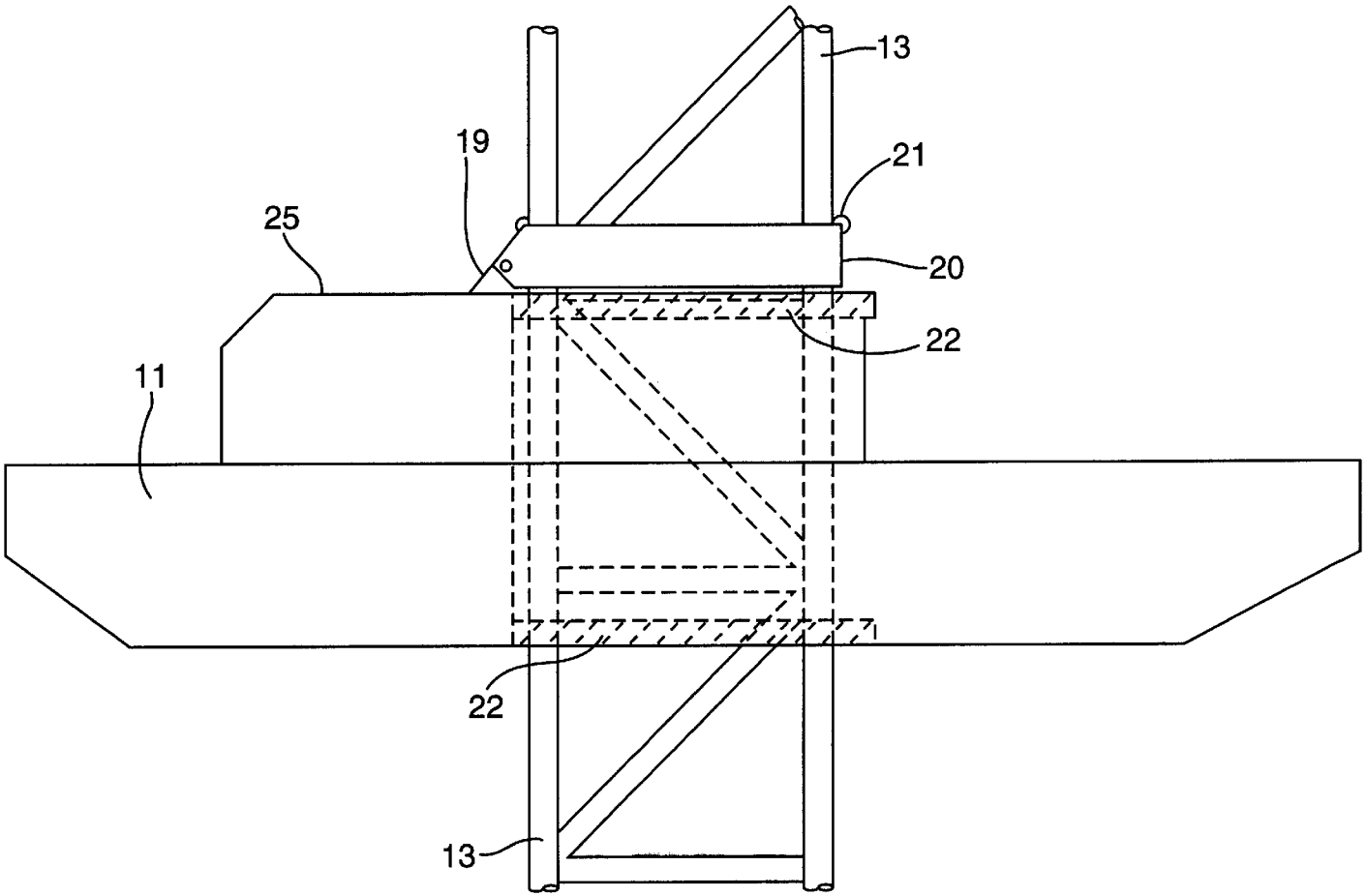
FIG. 6 is a side view of the construction jack-up barge with the column in the vertical position, also showing the pivotal connection between the barge and column.
Figure 10:
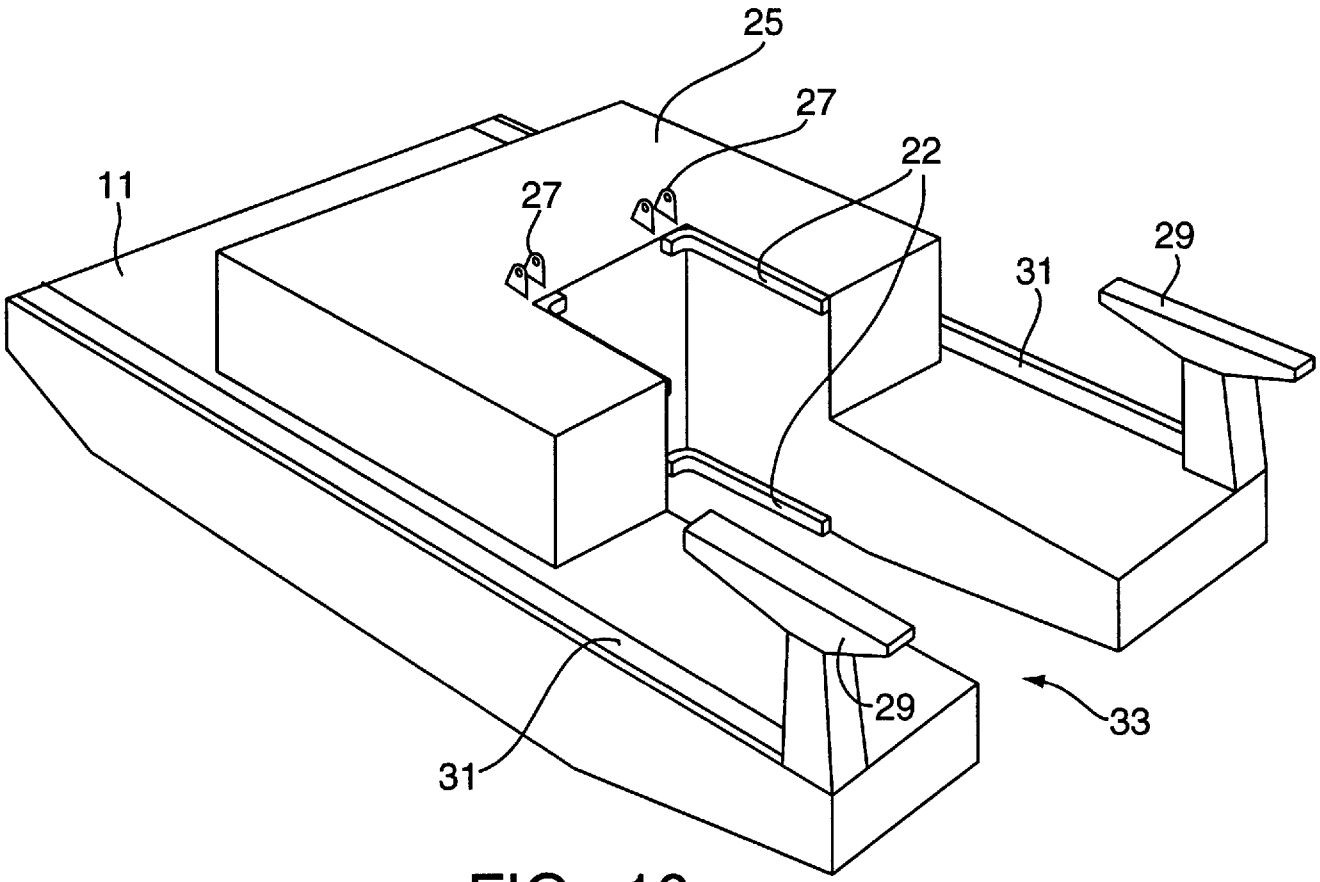
FIG. 10 is a perspective view of the barge.

The tower 13 is pivotable from the horizontal position as shown in FIG. 5 to a vertical position as shown in FIG. 6, the vertical position corresponding to the deployed condition. The tower 13 is guided in the vertical position by two guide assemblies 22 and the travelling frame 20, which allow for sliding vertical movement of the tower 13 therein. Each guide assembly 22 has removable end portions 23 which are locked into place after the tower has been received within the guide assembly 22. The guide assemblies 22 and moveable end portions 23 are preferably lined with a bearing surface such as ultra-high molecular weight polyethylene (uhmw). Movement of the removable end portions 23 is accomplished by two hydraulic rams 24, one connected to each end portion 23. The guide assemblies 22 are provided at the top of the cabin superstructure 25 of the barge 11, and in the hull below the waterline of the barge 11. The guide assemblies 22 may be considered as defining an opening which extends vertically from the bottom of the hull through to the deck of the barge, for receiving the tower in the vertical position. Referring now to FIG. 10, the guide assemblies 22 and clevis-like parts 27 of the pivotal connection 19 may be seen, in the perspective view of the barge 11.

The barge 11 includes a pair of gantry type cranes 29, each mounted on a track 31 for movement fore and aft, along the side of the barge 11. Removable cantilever beams 32 are provided at the stern of the barge 11 in order to permit outboard travel of the gantry cranes 29, to provide greater access for hoisting loads and reduce the turning moment exerted on the crane when doing so.

The barge 11 also includes a central cut out portion 33 extending from the stern of the barge 11, to the opening through which the tower 13 extends in the vertical position. The central cut out portion 33 extends vertically through the hull and deck of said vessel, and provides a pathway for transit of the tower 13 between the horizontal and the vertical positions.

Referring now to FIGS. 1–4, the construction jack-up barge includes enough stowage space on the deck, alongside the tower 13, for storage of further tower sections 35, which are provided to be fitted to the top of the tower 13, once it has been deployed in the vertical position, and the barge 11 has been jacked up the tower 13.

Figure 2:
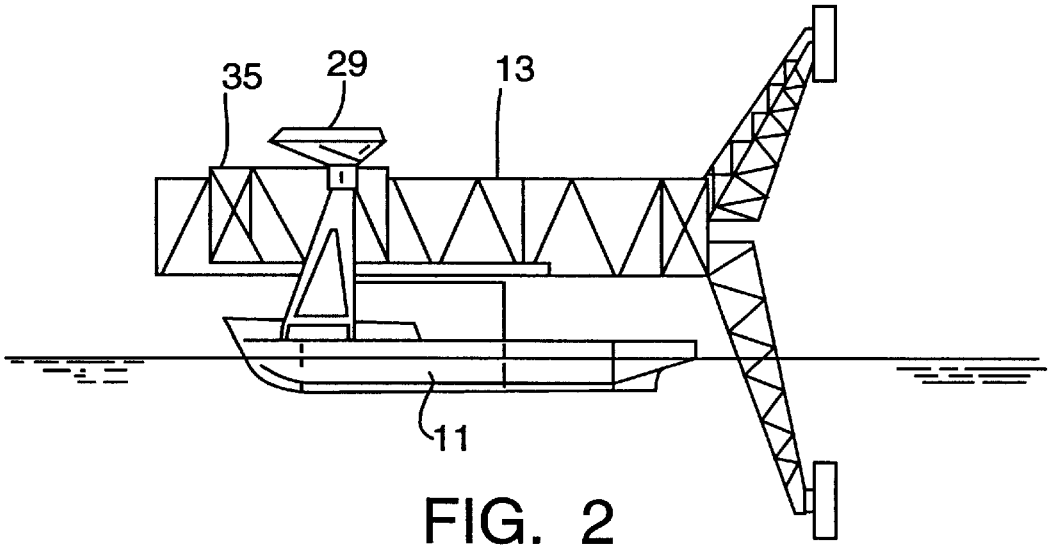
FIG. 2 is a side view of the construction jack-up barge showing the weight distribution structure of the column being deployed.

Deployment of the tower 13 to the vertical position begins with the folding out of the legs 15 to the outward position as shown in FIG. 2, at which they are secured. The cranes 29 are utilized at this stage to assist with laying back of the legs 15 and the footing assemblies 17. The lowermost leg 15*a* and its footing 17 passes through the central cut out portion 33.

Figure 3:
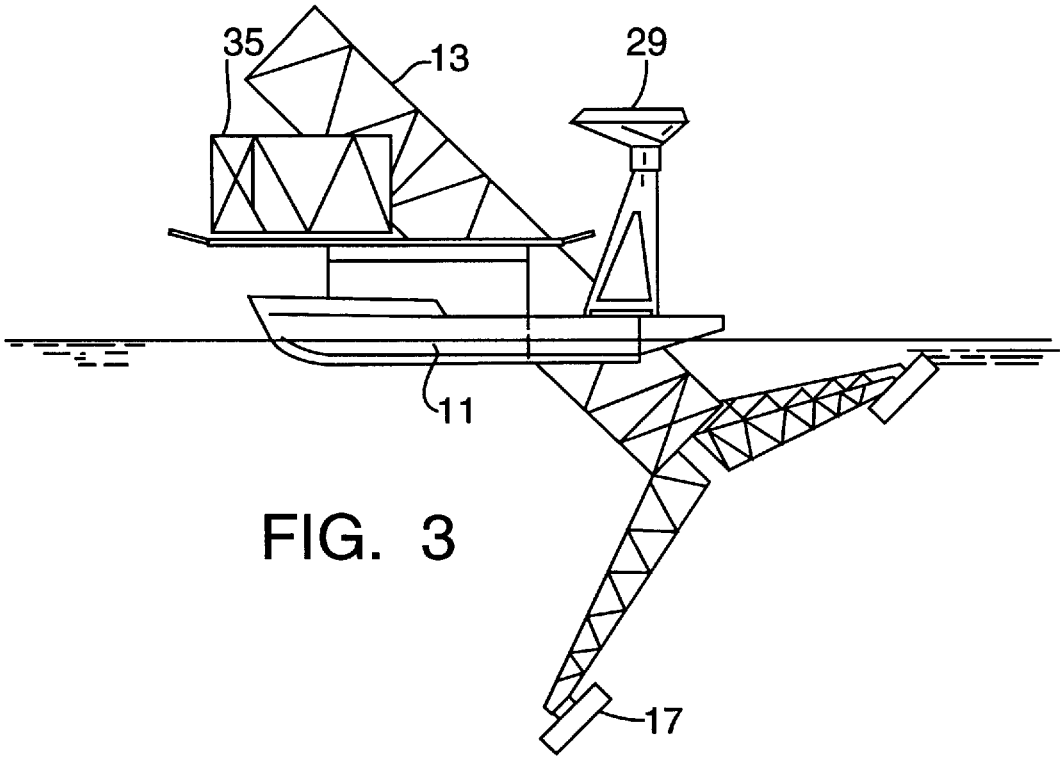
FIG. 3 is a side view of the construction jack-up barge showing the column being deployed.
Figure 4:
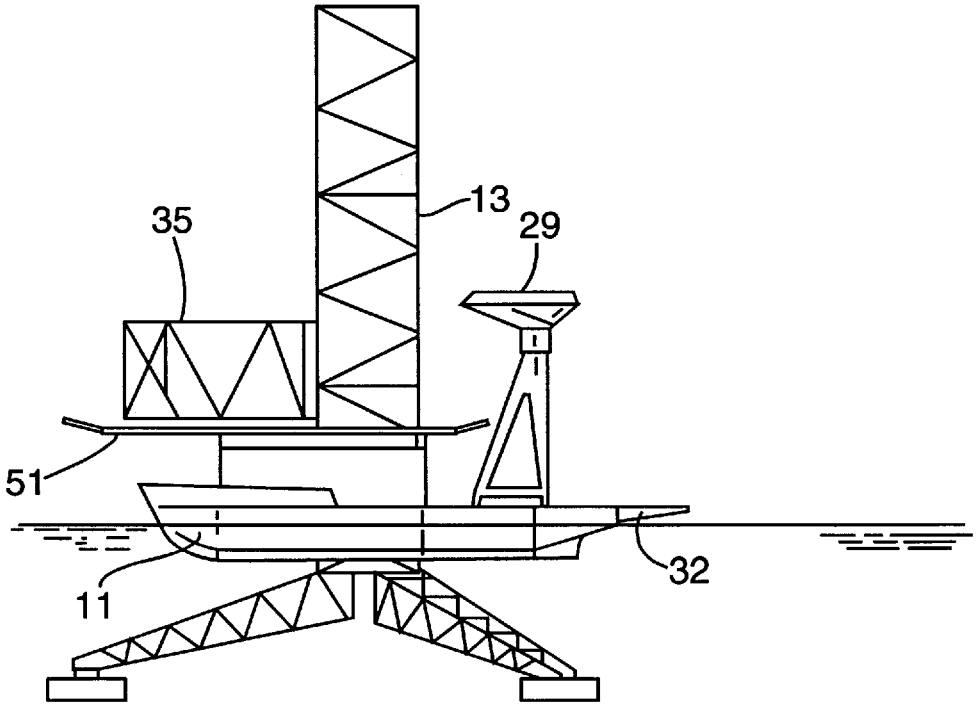
FIG. 4 is a side view of the construction jack-up barge showing the column deployed in an in field transit configuration.

The cranes 29 are then used to assist in rotating the tower 13 from the horizontal stowed position shown in FIG. 1, through the position shown in FIG. 3, until the tower 13 reaches the vertical position shown in FIG. 4.

Figure 8:
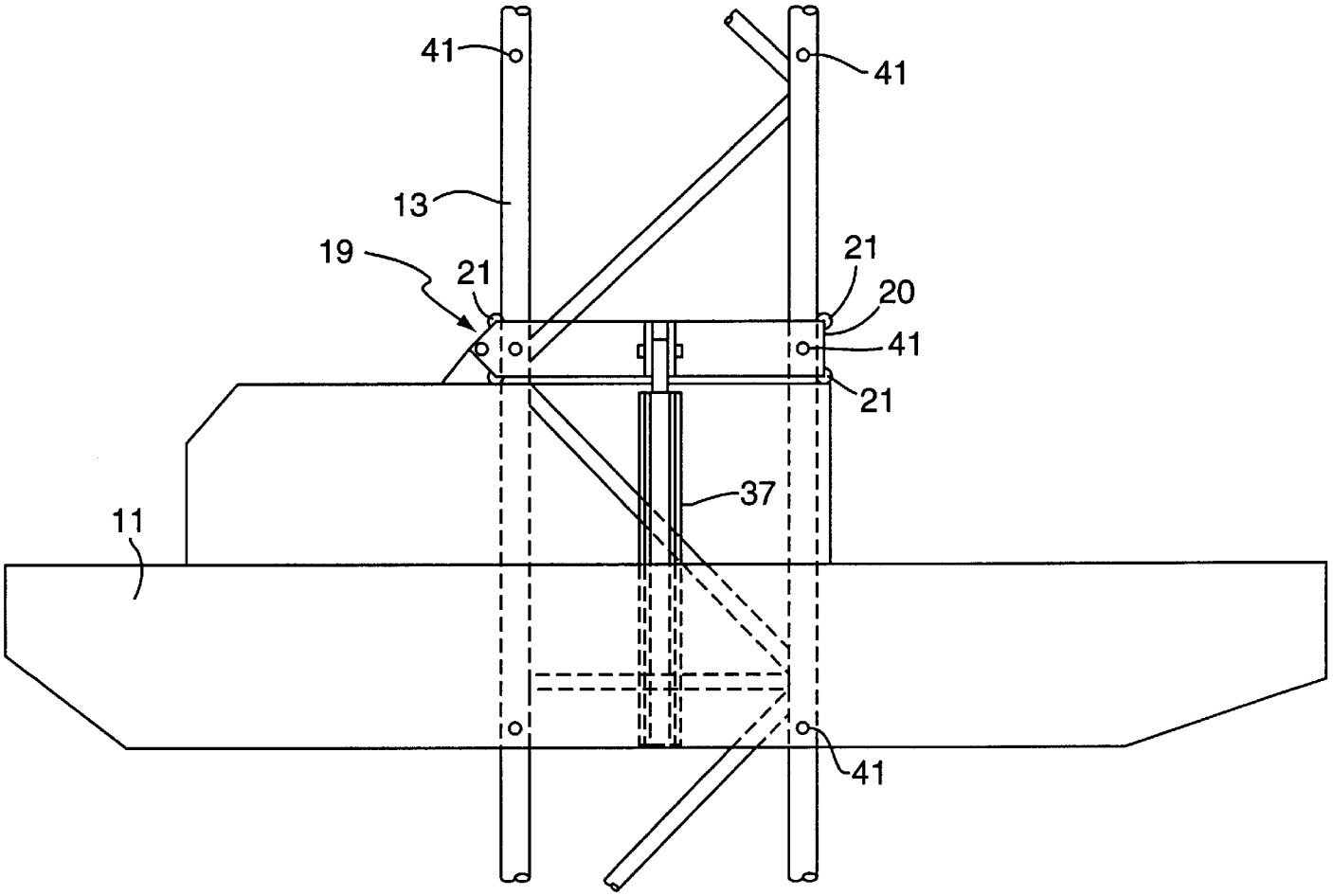
FIGS. 8 and 9 are side views showing hoisting means for moving the barge and column relative to each other.
Figure 9:
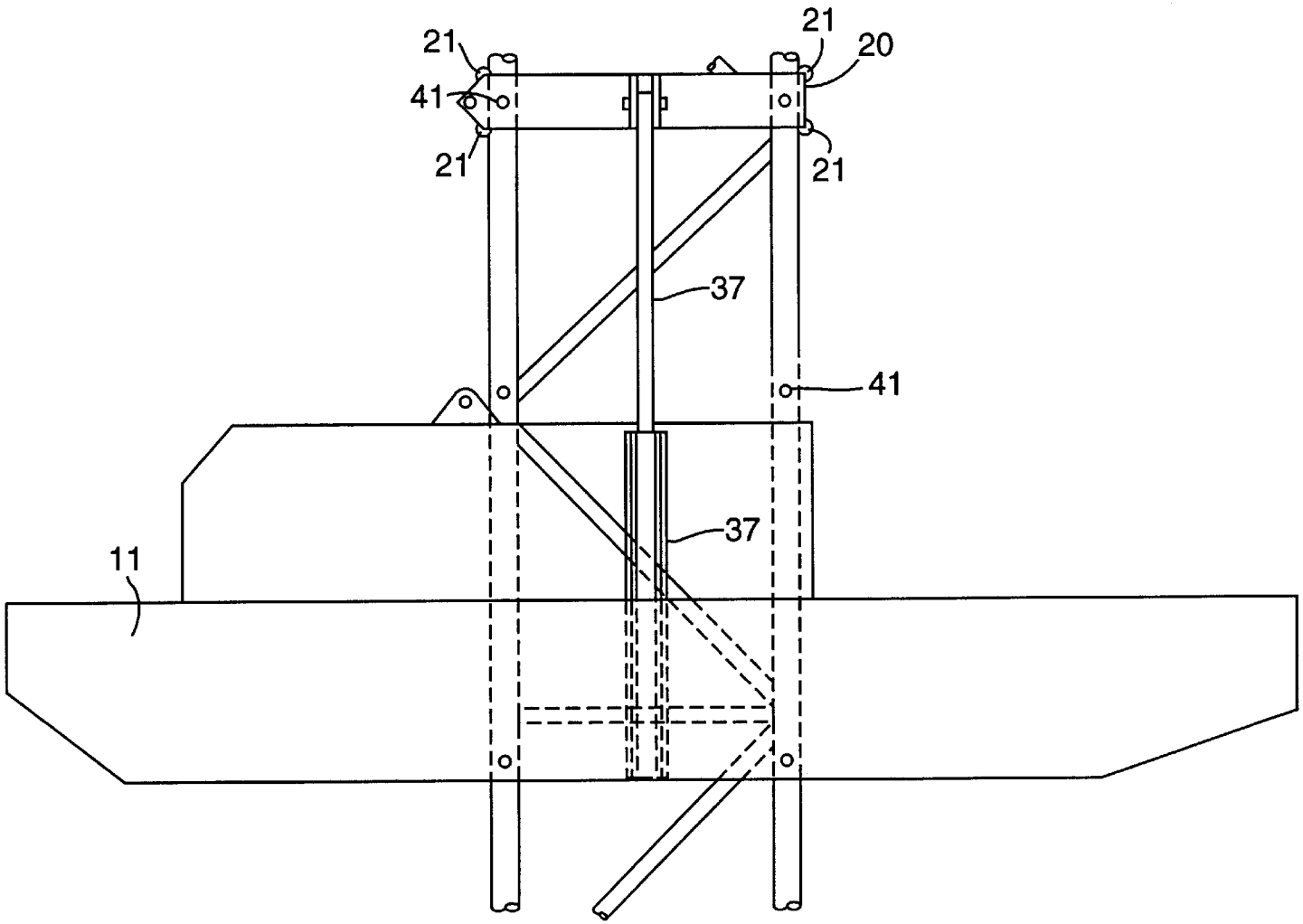

Hoisting of the tower 13 relative to the barge, either upwards or downwards is provided for by a pair of 4.5 meter tension type jacks 37 which connect to the travelling frame 20 which may be pinned to the tower cords through apertures 41 located therein. The jacks 37 are shown in the retracted position in FIG. 8, and the extended position in FIG. 9. In order to lower the tower 13 relative to the barge 11, and pull the barge up the tower, once the footings 17 reach the seabed, the pivotal connection 19 is broken, and then the frame 20 is secured to the tower 13 as shown in FIG. 9, and the jacks 37 are retracted to the position shown in FIG. 8. The tower 13 and barge 11 are pinned together, while the frame 20 is detached from the tower 13, and moved to the extended position as shown in FIG. 9, before being secured again for repeating of the step.

In order to raise the tower 13 relative to the barge, (i.e. lower the barge 11 on the tower 13) the same operation is performed, but in reverse.

Figure 7:
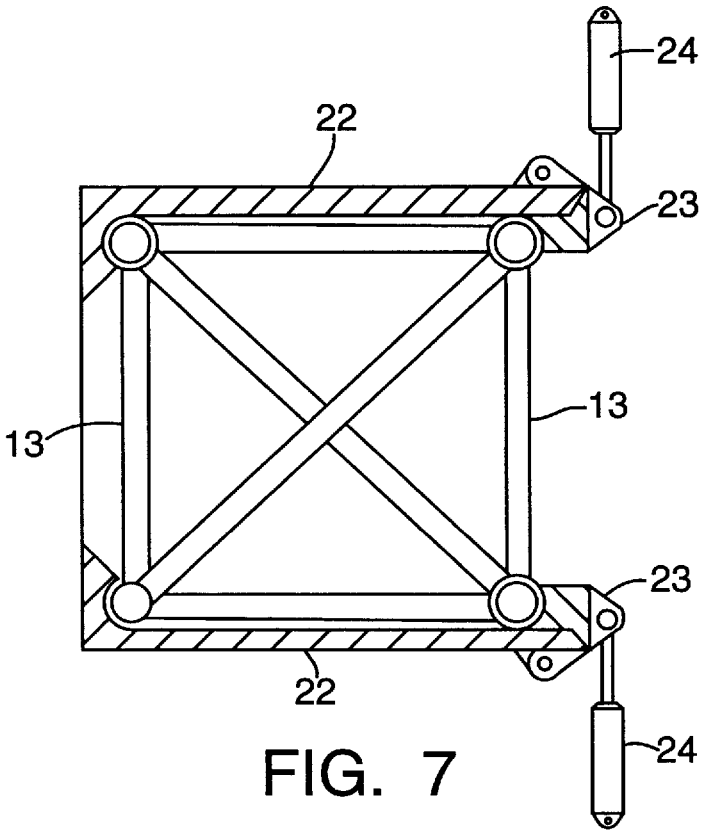
FIG. 7 is a plan view of guide means for the column in the vertical position.

Referring now to FIG. 7, once the tower 13 reaches the vertical position, the end portions 23 of the guide assembly 22 are fitted in place, to lock the tower 13 in the vertical position. The jacks 37 are then fitted and the pivotal connection 19 is broken, and the tower 13 may be jacked down until the footing assemblies 17 reach the seabed. Alternatively, if it is desired to set the offshore installation up in shallow water, the tower 13, with its legs extended, may be raised to as high a position as possible, as shown in FIG. 4, to provide minimum draft while the barge 11 and tower 13 are manoeuvred to the final site for the offshore installation.

To assist with settling the footing assemblies 17 in the seabed, whilst minimizing their weight for transport, the footings are of hollow construction and floodable with seawater, in order to reduce their buoyancy. Conversely, to assist in dislocating the footing assemblies 17 from the seabed, if it is desired to dismantle the offshore installation, an air pump and valve assembly is provided for each footing assemblies 17 so that the footing assemblies 17 may be filled with air to displace the water, and to increase the buoyancy of the footing assemblies 17 as the tower 13 is raised relative to the barge 11.

Figure 11:
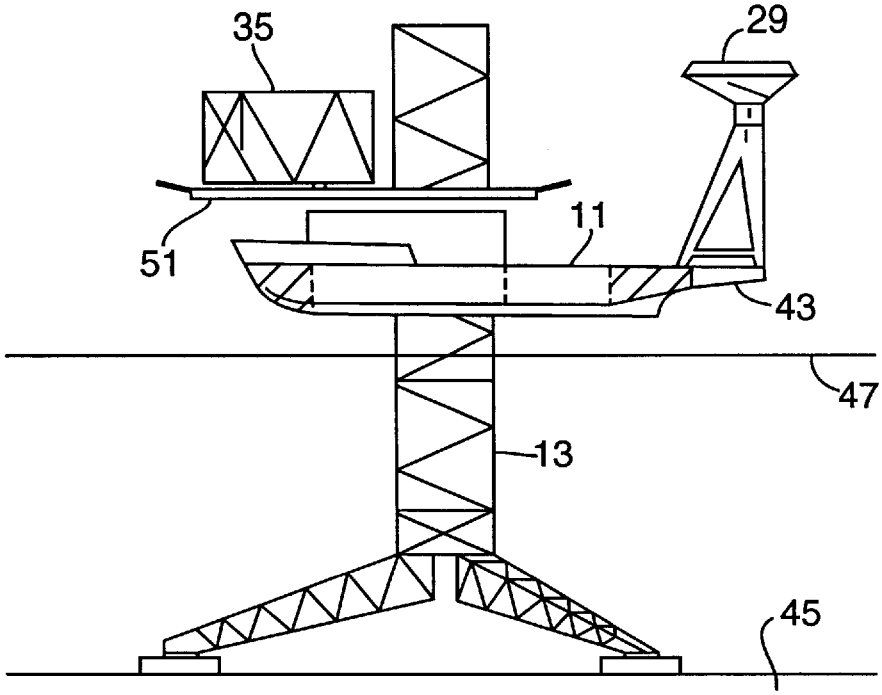
FIG. 11 is a side view of the construction jack-up barge shown in a pre-load configuration.
Figure 11A:
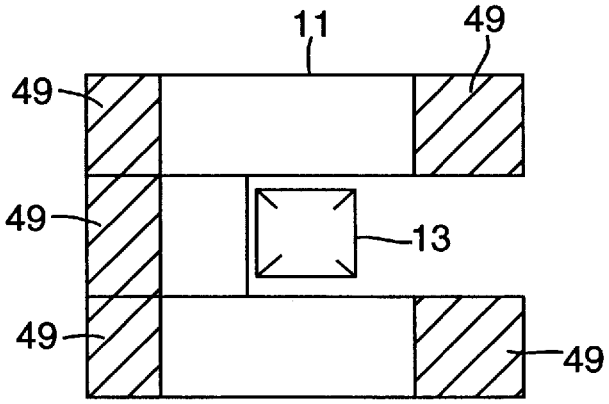
FIG. 11*a* is a plan schematic showing the ballast configuration of the barge for pre-load configuration.

Referring now to FIG. 11, once the footing assemblies 17 have reached the seabed 45, the barge 11 is jacked up the tower 13, clear of the surface 47 of the sea. The barge 11 has three separate sea water ballast tanks 49, which are filled to increase the downward bearing weight on the tower structure 13, and settle the footing assemblies 17 in the seabed. The seawater ballast tanks 49 may be filled appropriately to counterbalance any uneven loading on the barge 11. It will be understood that the number of ballast tanks incorporated into the barge may be varied as required. The footing assemblies 17 also include height adjustment means, to counteract the effects of the seabed 45 being uneven or there being uneven settling of the footing assemblies 17 into the seabed 45.

Figure 12:
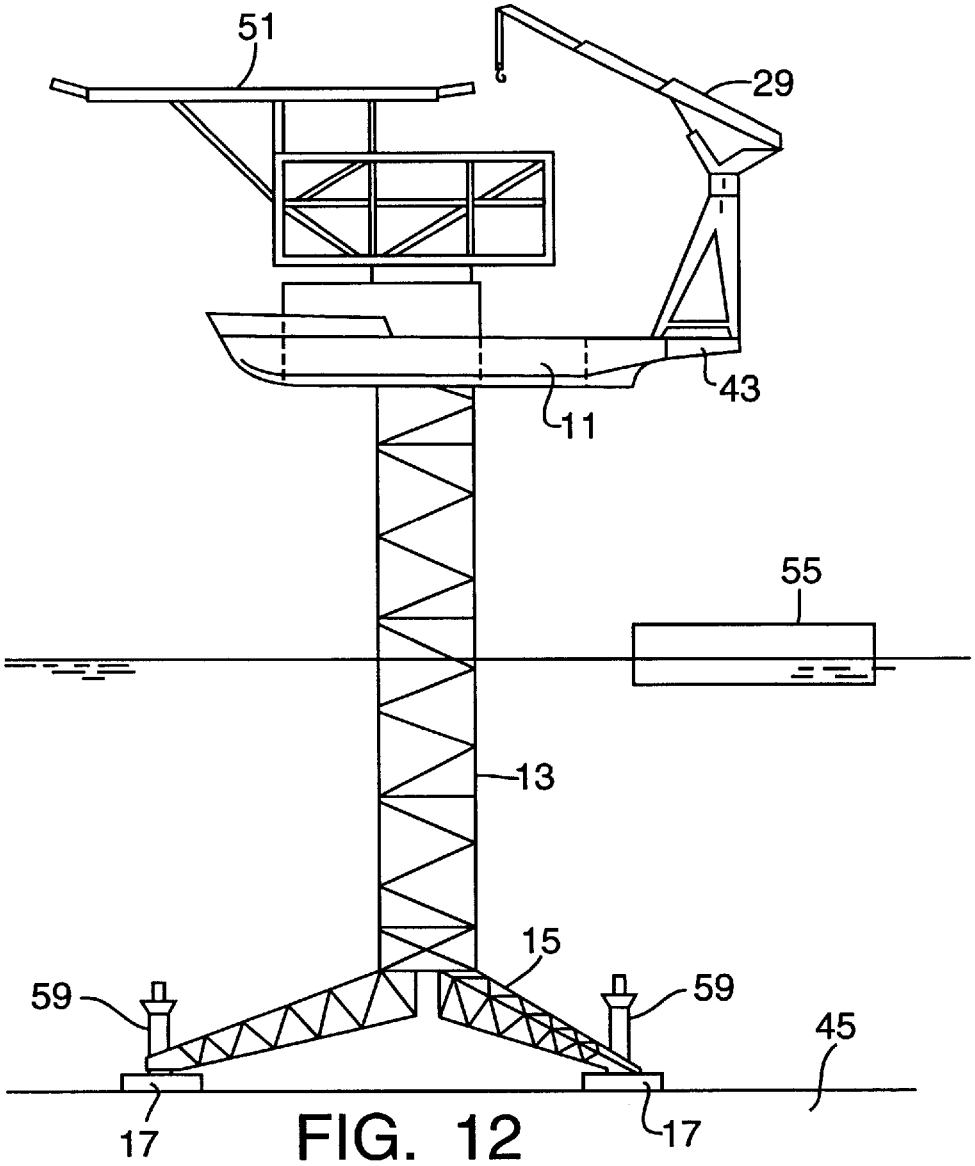
FIG. 12 is a side view of the construction jack-up barge shown preparing a permanent offshore platform installation.
Figure 13:
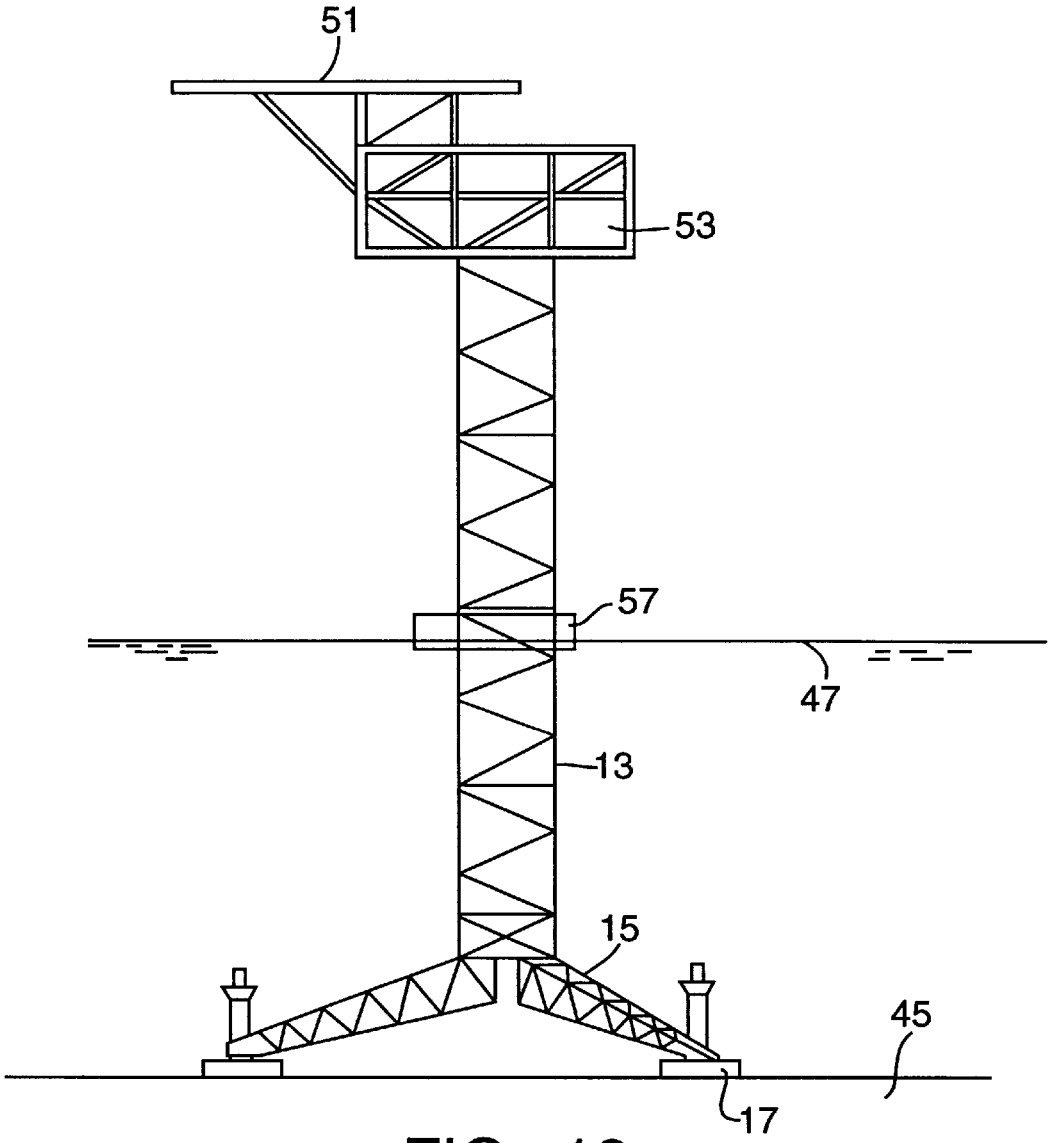
FIG. 13 is a side view of the completed permanent offshore platform installation.

Referring to FIGS. 12 and 13, steps in the construction of a permanent offshore installation incorporating a heli-deck 51 and living and working space 53, are shown. The crane 29 is shown in FIG. 12 positioning tower sections 35 atop the tower 13 until the desired height is reached, whereupon the heli-deck 51 and other structures are installed. A material barge 55 is shown in FIG. 12, and is utilised in order to bring additional materials to the construction site as required.

Once the offshore installation has been completed, the barge 11 may be lowered down to the sea surface, and disengaged and manoeuvred away from the tower 13. In FIG. 13, a floating boat landing 57 which extends around the tower 13, is shown. The boat landing 57 is fitted once the barge 11 has left. Hoists on the super structure of the installation may be utilized to hoist the boat landing clear of wave action, when it is not in use, or when there are large seas or swell. The footing assemblies 17 are shown with foundation piles 59 providing securing of the offshore installation to the seabed 45.

Figure 14:
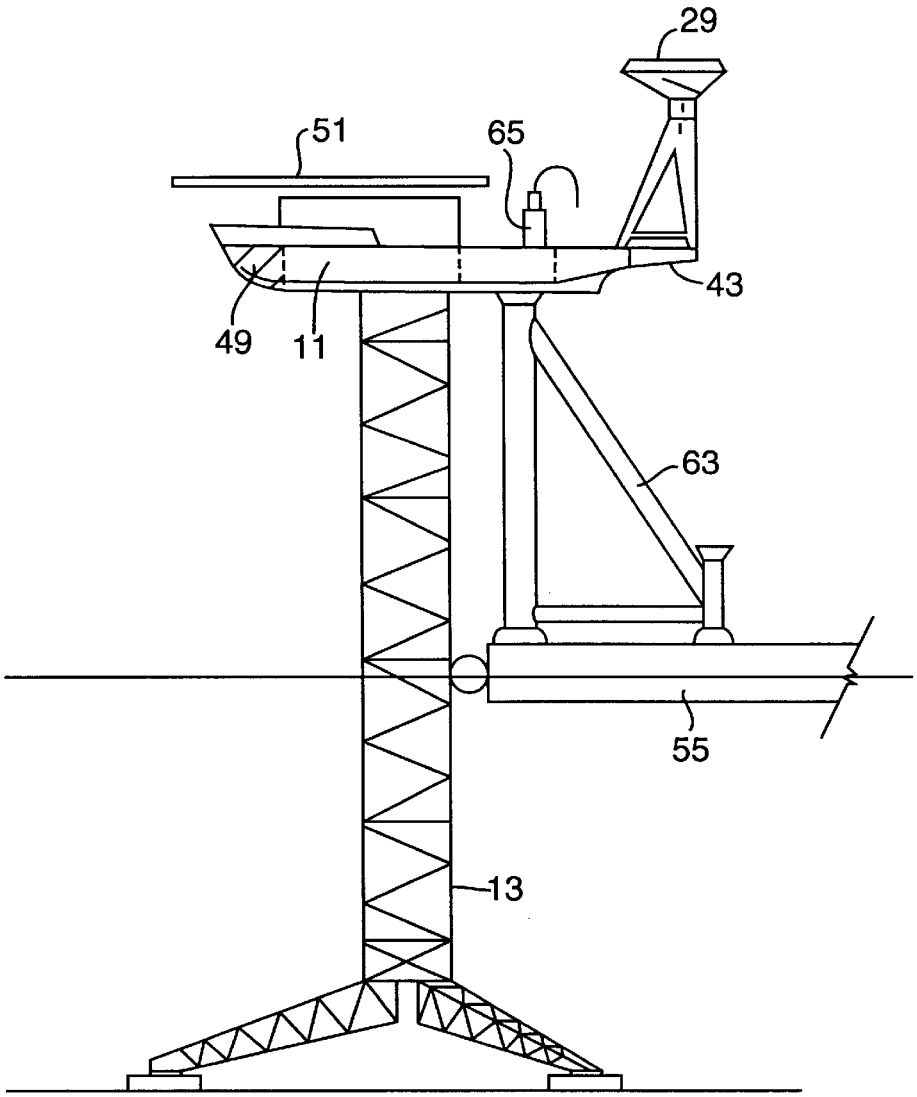
FIG. 14 is a side view of the construction jack-up barge showing stage 1 of a typical installation sequence.
Figure 14A:
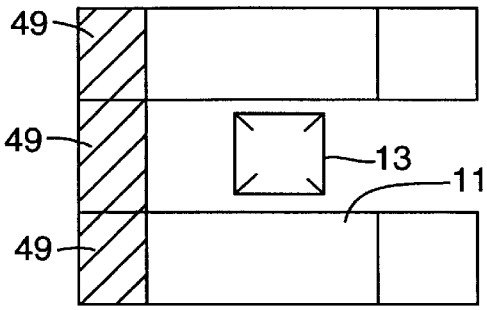
FIG. 14*a* is a plan view of the ballast configuration of the construction jack-up barge for stage 1 of the installation sequence shown in FIG. 14.
Figure 15:
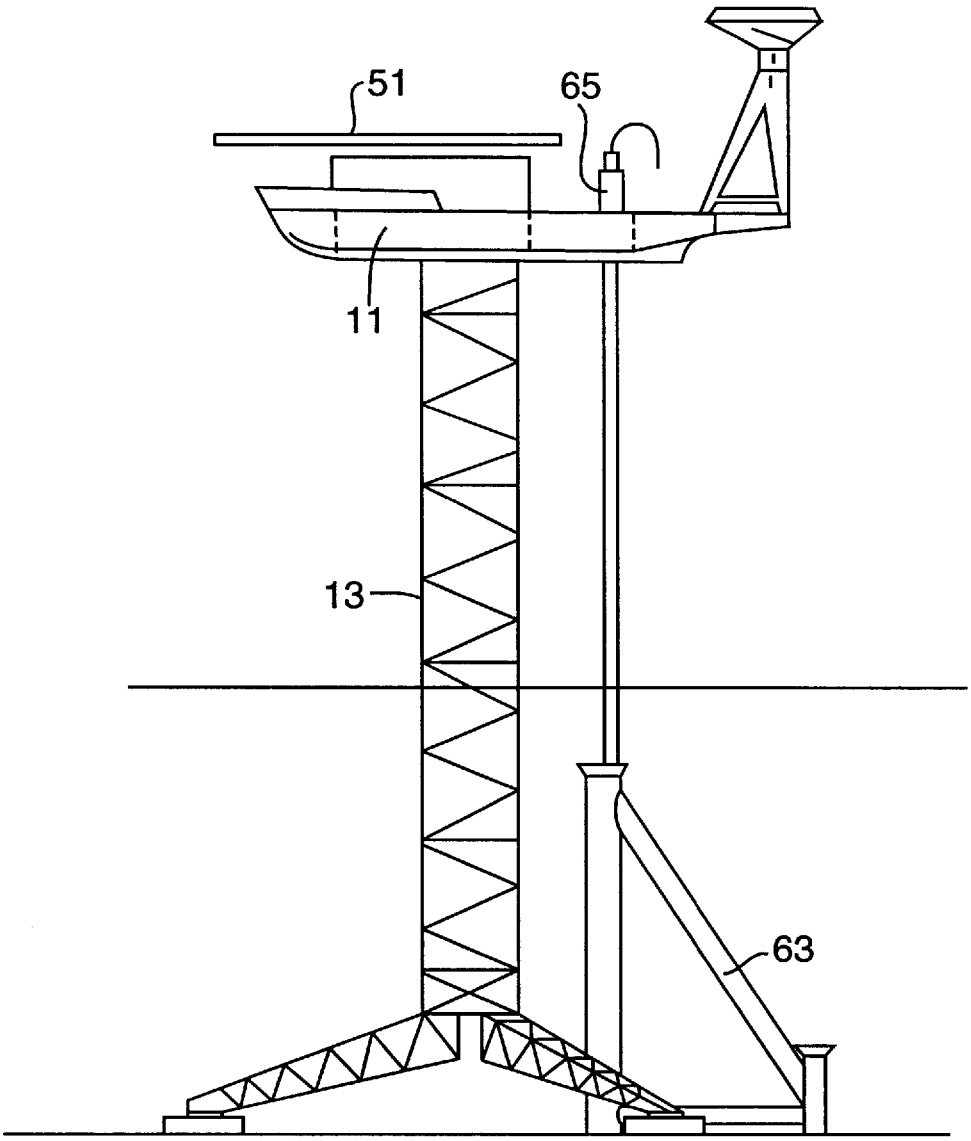
FIG. 15 is a side view of the construction jack-up barge showing stage 2 of the installation sequence.
Figure 16:
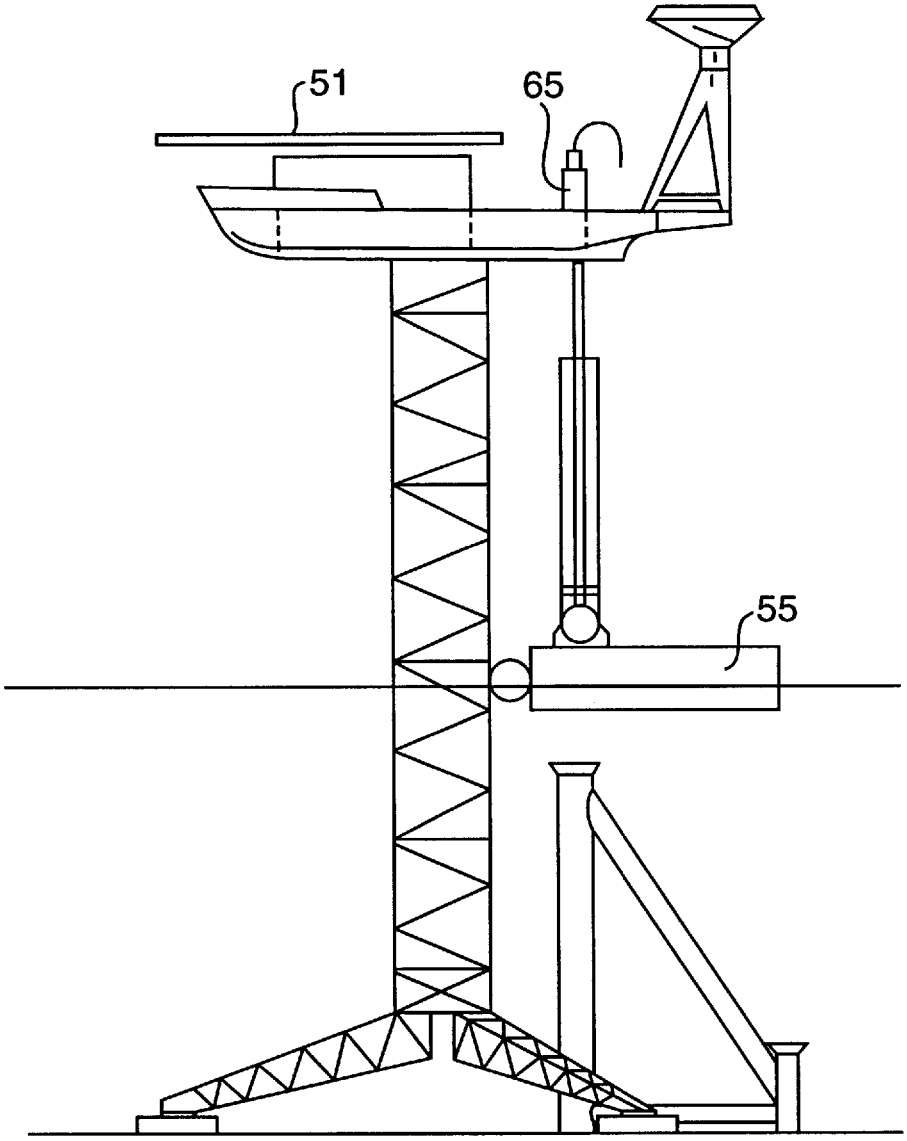
FIG. 16 is a side view of the construction jack-up barge showing stage 3 of the installation sequence.
Figure 17:
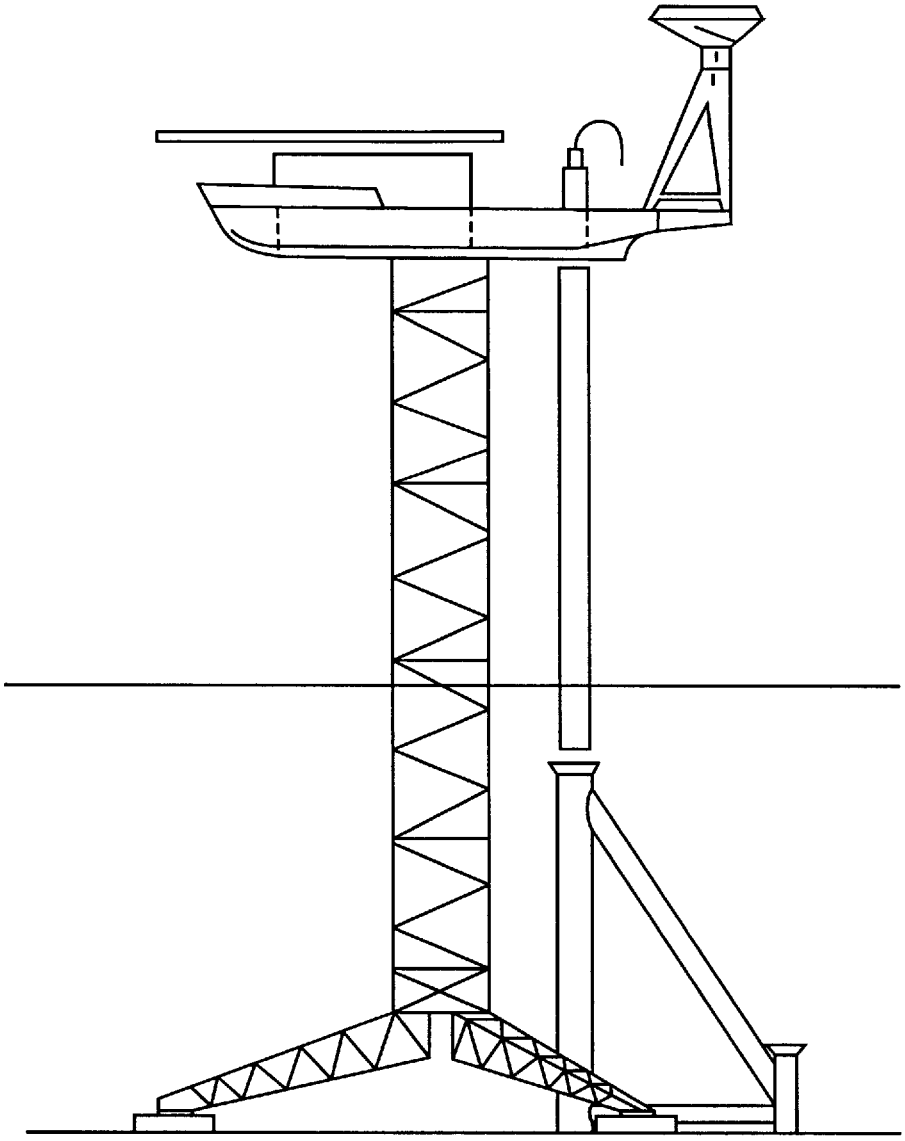
FIG. 17 is a side view of the construction jack-up barge showing stage 4 of the installation sequence.
Figure 18:
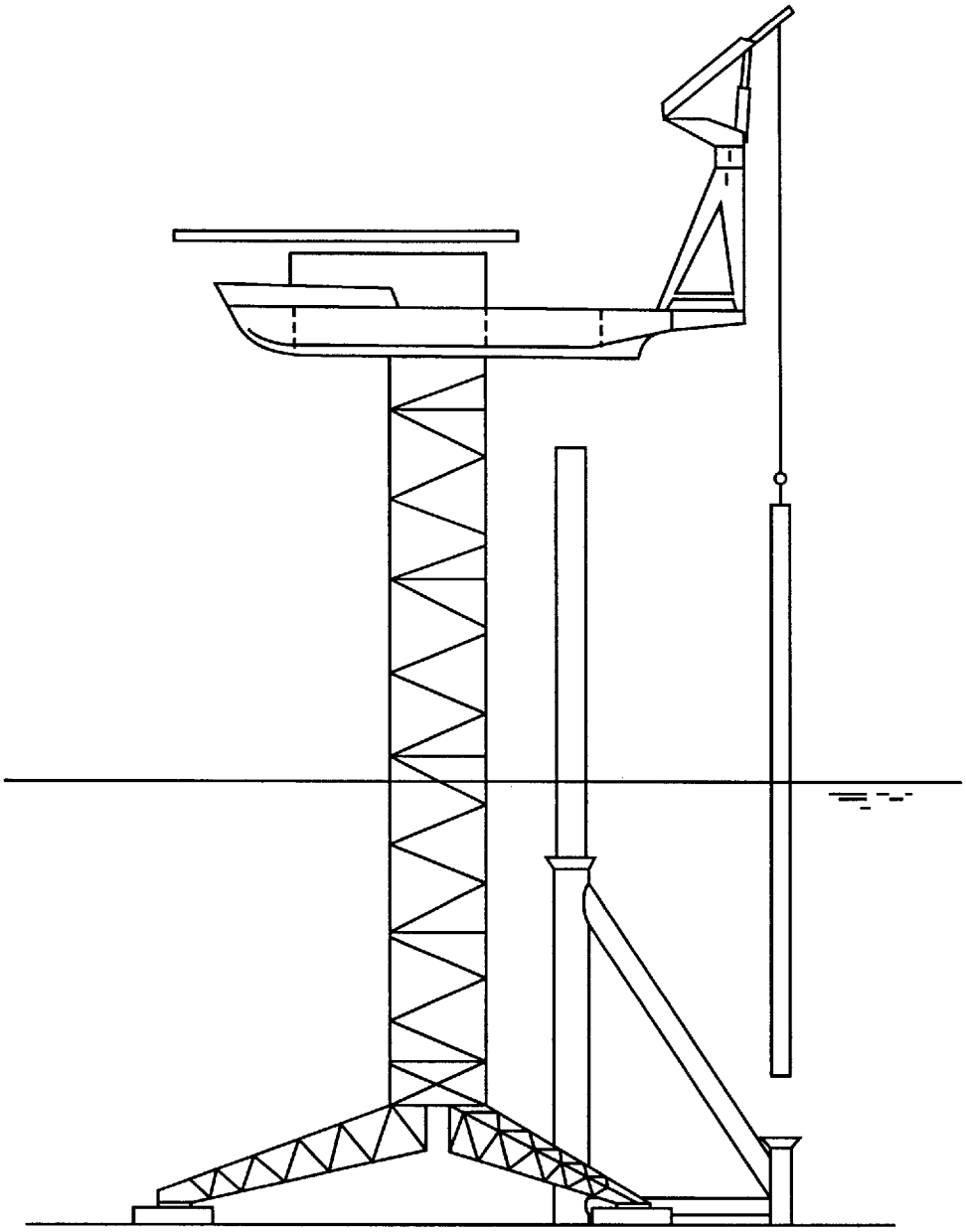
FIG. 18 is a side view of the construction jack-up barge showing stage 5 of the installation sequence.
Figure 19:
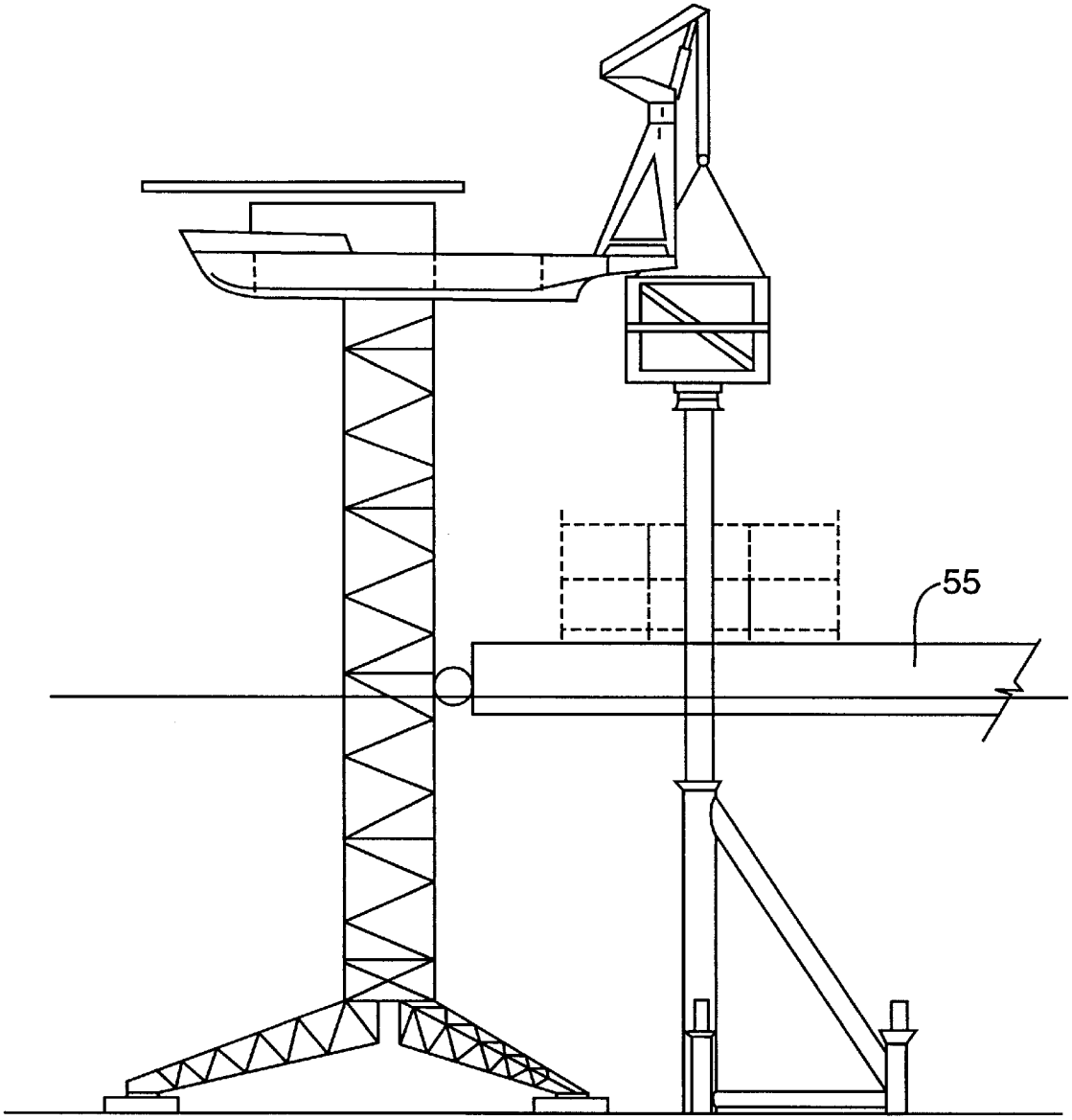
FIG. 19 is a side view of the construction jack-up barge showing stage 6 of the installation sequence shown in FIG. 14.
Figure 20:
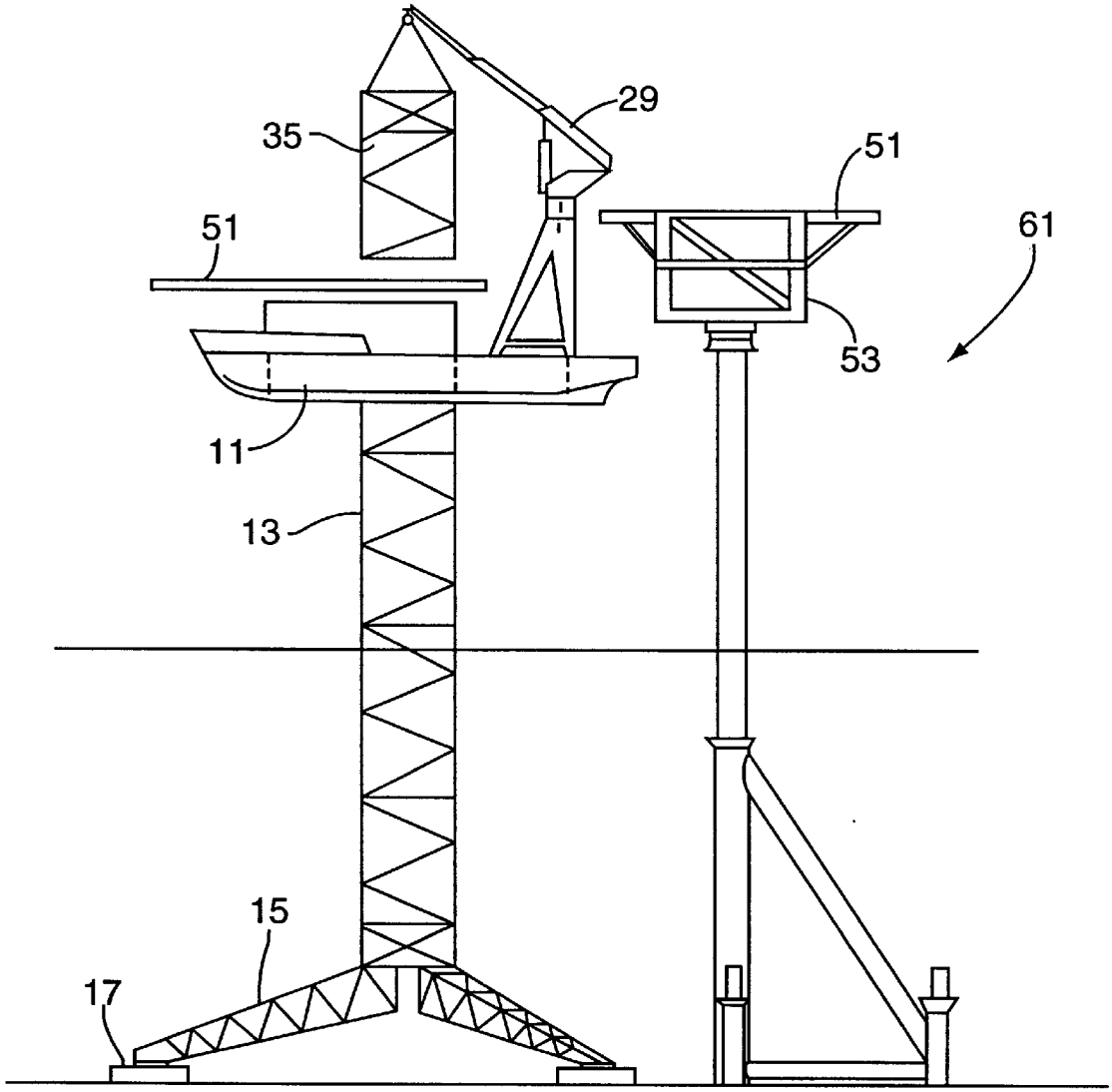
FIG. 20 is a side view of the construction jack-up barge showing the dismantling thereof after completion of the installation sequence shown in FIGS. 14 to 19.

FIGS. 14 to 19 show steps in building an offshore installation 61 using the construction jack-up barge and tower assembly. FIG. 14*a* shows the seawater ballast tanks 49 which are employed in such applications. Hoisting of a primary substructure 63 is achieved by a pair of strand jacks 65 mounted on a beam across the central cut out portion 33 of the barge 11. Referring to FIG. 20, once the offshore installation 61 is complete, the installation tower formed by the construction jack-up barge 11 and its tower 13 are dismantled and returned to the stowed condition, as shown in FIG. 1.

Figure 21:
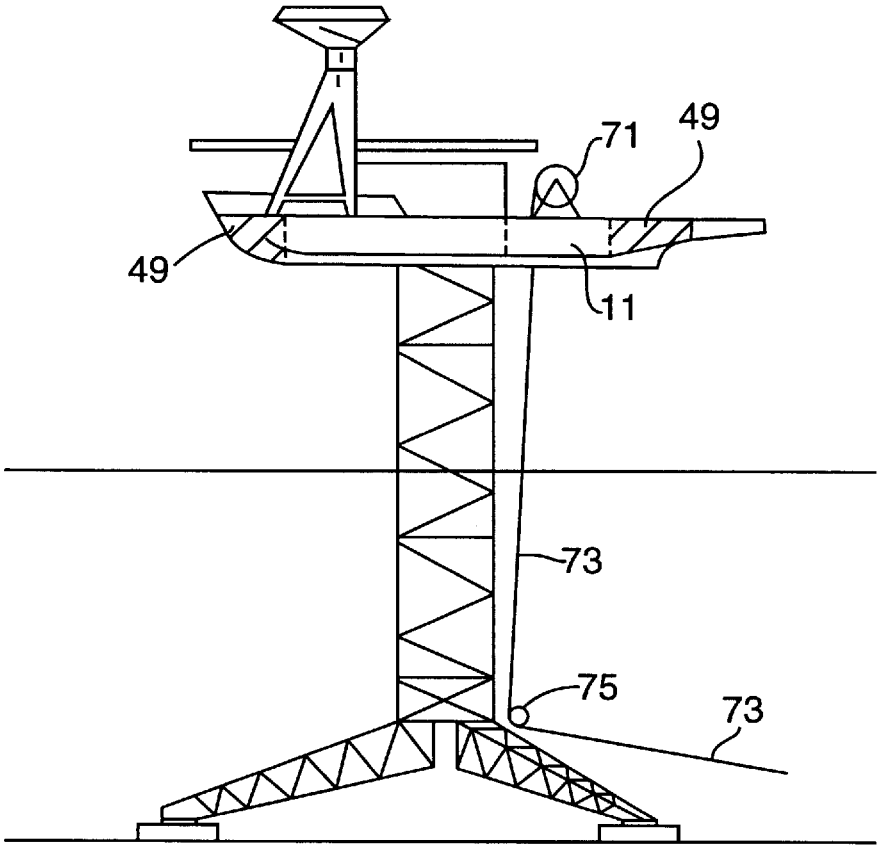
FIG. 21 is a side view of the construction jack-up barge equipped with a haul winch for hauling materials along the seabed.

Referring to FIG. 21, the construction jack-up barge assembly is shown in a hoisting configuration, for hoisting undersea pipelines or cables or the like. A rotary drum hoist 71 is fitted to beams extending across the central cut out portion 43 of the barge 11, and exerts tractive force on a cable 73 which extends downward to a pulley 75 located below the surface 47 of the sea, the cable 73 then extending outward, to where it is joined onto pipelines or cables which are being pulled out toward the construction jack-up barge.

Figures 22, 22A, 22B, 22C:
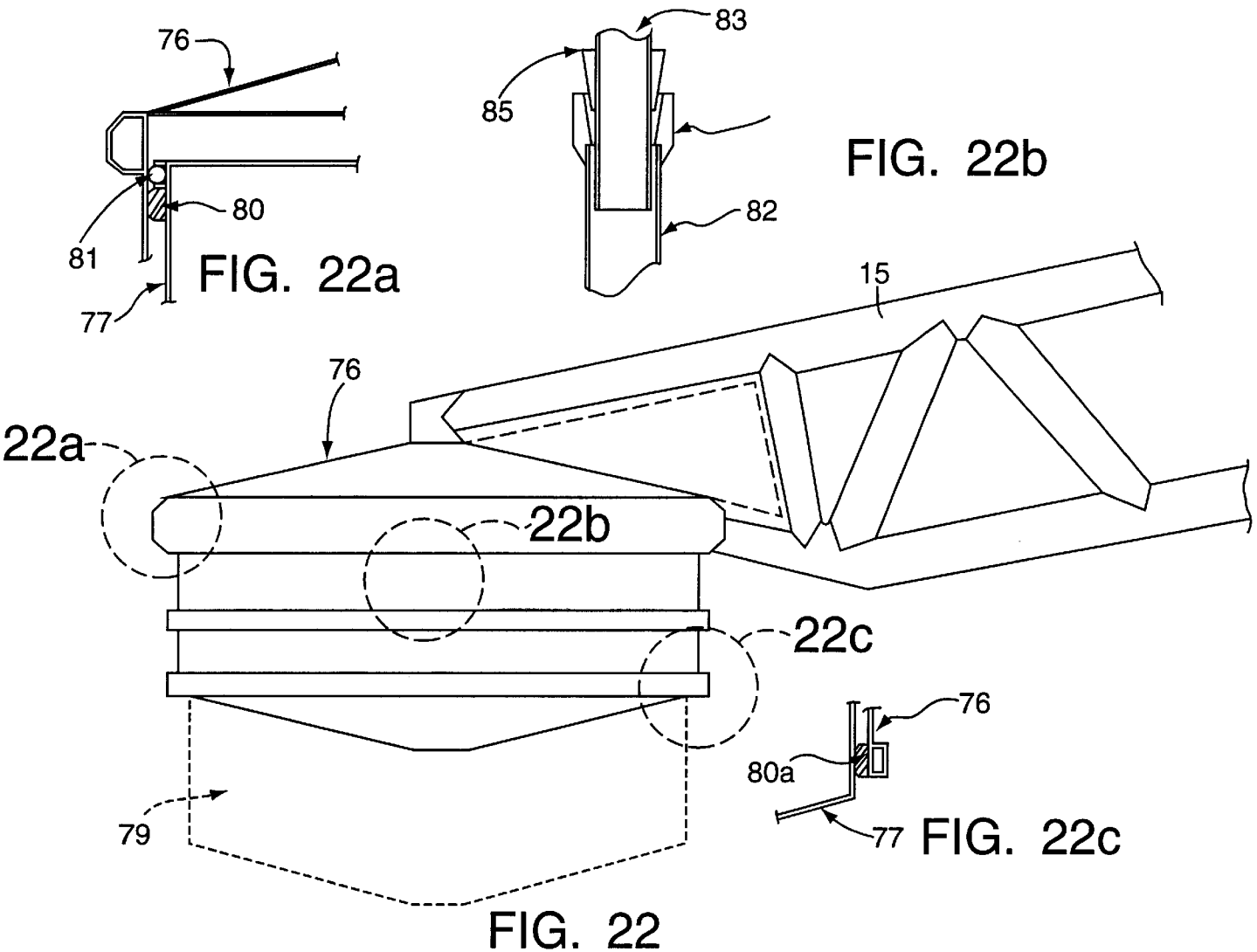
FIG. 22 is a view of detail of a footing assembly.
FIG. 22*a* is a cut away view of detail of part of the footing assembly shown in FIG. 22.
FIG. 22*b* is a cut away view of detail of the axial guide for the footing assembly shown in FIG. 22.
FIG. 22*c* is a cut away view of detail of the footing assembly shown in FIG. 22.

Referring now to FIG. 22, details of the most preferred footing assembly are shown. Each footing assembly 17 comprises a sealable enclosure formed by an upper cup 76 and a lower cup 77. The upper and lower cups 76 and 77 are of cylindrical form, with the lower cup 77 being of smaller diameter than the upper cup 76. The lower cup 77 is arranged for telescoping movement within the upper cup 76 and may be pressurised or have the volume of water or air within the enclosure formed by the cups varied, to provide a travel of nominally 1.5 meters vertically in relation to the upper cup, providing planar and settlement adjustment for the tower structure. The lower cup 77 is shown in the extended position in dashed outline, indicated at 79.

The cups are nominally 5.5 meters in diameter and approximately 2.9 meters in depth.

A pair of circular bearing pads 80 and 80*a* attached to the lower cup 77 and upper cup 76 respectively, provide bearing surfaces for relative movement of the cups. The sealable enclosure is maintained sealed from the outside environment by a packer 81 formed of rubber or a composite synthetic material. Alternatively, the packer may be an inflatable type which may receive fluid under pressure to prevent leakage therepast from the sealable enclosure, to permit pressurisation of the sealable enclosure with either air or water. If required, further packers may be provided to give some redundancy, ensuring that the event of leakage past one packer will not cause failure of the footing.

The top and bottom of the cups are formed as a flattened cone with the tower outrigger structure/legs 15 tied directly into the upper cup 76.

An axial guide assembly is incorporated along the sealable enclosure/cup centreline, and comprises a pair of tubular members 82 and 83 attached to the lower cup 77 and upper cup 76 respectively.

A telescopic mechanical locking device consisting of a bearing collar 84 and an hydraulically operated wedge collar 85 is incorporated on the tubular members 82 and 83, to fix the cup travel after adjustment. The telescopic mechanical locking device may be-replaced by a grout plug, which is achieved by a conduit extending down the tubular member 83, to inject a settable grout composition, to secure the tubular members relative to each other. The grout plug arrangement would be utilized in more permanent installations which on decommissioning would require ejection of the set grout plug under hydraulic pressure, and disassembly of the sealable enclosure to remove the plug before the footing could be restored to a servicable condition.

The sealable enclosure includes valves to seal the interior thereof, the valves being connected to piping to selectively allow for flooding, venting, air blow down, and suction, and a pressure relief system to ensure that the footing is not overstressed. Water is used for pressurization for level adjustment. The footing assembly may be deballasted for additional buoyancy, using air blowdown.

While the footing described is particularly advantageous, alternate seabed support configuration options include conventional mud mats with hydraulic rams, fixed mud mat and pile sleeve combinations for permanent piled installation and a rectangular footing with a plan area similar to that of the jack-up barge.

Apart from the seawater ballast tanks 49, below the cabin superstructure 25, there is provided one level of accommodation including a workshop, stores, a galley and mess, and a lounge, including space for storage of food, water, and waste. In the cabin superstructure, there is provided accommodation for 28 workers, in addition to the ablutions and other space as may be required. The central cut out portion 33 has removable decking, which may be put into place when construction work has been completed. This is particularly useful, if the barge 11 is to be used as accommodation space atop a tower in an offshore installation.

The construction jack-up barge according to the invention offers advantages over existing known equipment. It may be conveniently deployed in shallow water, and relatively deep water although, it is primarily intended for application in waters having a depth range from 4 to 40 meters, assuming a tidal range of 3 m. The barge in the embodiment has a length of 27 meters and a beam of 20 meters, with a loaded draft ranging from 4 to 9 meters.

The principle of using a single tower allows floating access beneath the barge which allows loads to be positioned closer to a crane located on the barge. This decreases the turning moment placed on any crane, especially where the crane pedestal is located near the edge of the deck of the barge, due to the configuration of a single tower allowing heavy loads to be lifted closer to the pedestal of the crane.

The single tower with the three leg or outrigger distribution structure at the base also permits better distribution of loads onto the seabed.

Furthermore, and importantly, the method of stowage of the tower, whereby the tower is laid out in a substantially horizontal position, reduces the height of the overall assembly above the water line, and allows access of the jack-up barge assembly to areas on water, where due to height restrictions, traditional jack-up barges would not be able to reach.

The erected tower may support more than one jack-up barge if this is required. This enables a further barge containing process equipment or the like to be deployed on the same erected tower.

It should be appreciated that the scope of the invention is not limited to the embodiment described herein, whereby the invention may be applied to jack-up barges having more than one column or tower.

I claim:

1. A vessel adapted for deployment as an offshore structure supported above the sea floor, said vessel including a support structure for supporting a column for rotation between a substantially horizontal stowed position and a vertical position for deployment, wherein said support structure includes a carriage for supporting said column for selective sliding movement in relation thereto while said column is in said vertical position wherein said vessel includes an element allowing for said vessel and said column to be connected to enable said vessel to dock to said column in said vertical position, and disconnected to enable said vessel to embark from said column in said vertical position, and wherein said vessel includes guide means for guiding sliding movement of said column in relation thereto while said column is in said vertical position.

2. A vessel as claimed in claim 1 wherein said support structure includes a pivotal connection point for forming a pivotal connection between said column and said vessel.

3. A vessel as claimed in claim 2 wherein said pivotal connection extends between said carriage and said vessel.

4. A vessel as claimed in claim 3 wherein said pivotal connection is selectively connectable to enable said vessel to dock to and embark from said column in said vertical position.

5. A vessel as claimed in claim 1 wherein said carriage includes concave shaped pulleys for guiding said column.

6. A vessel as claimed in claim 1 wherein said element comprises a pivoting portion on said vessel which in a closed condition secures said column for sliding movement, and restrains said column in said vertical position.

7. A vessel as claimed in claim 1 wherein said vessel includes hoisting means for moving said column vertically relative to said vessel, when said vessel is attached to said column and when said column is in said vertical position.

8. A vessel as claimed in claim 1 including an opening located near the center of said vessel and extending vertically through the hull and deck of said vessel, through which said column is received in said vertical position, said opening extending to an edge of the vessel to accommodate said column as said column is rotated between said vertical position and said substantially horizontal stowed position.

9. A vessel as claimed in claim 1 wherein said vessel includes floodable compartments to allow balancing of the weight distribution of said vessel, relative to said column.

10. A column for supporting said vessel and adapted for deployment as an offshore structure supported above the sea floor, said column having a support structure for selectively attaching to said vessel to allow said vessel to dock to and embark from said column, wherein said support structure includes a pivotal connection point for forming a pivotal connection between said column and said vessel when said column and said vessel are attached to allow said column to be rotated relative to said vessel from a horizontal stowed position to a vertical position for deployment and wherein said support structure includes a carriage adapted to traverse said column, and which may be fixed to said column to allow said column to be hoisted up and down relative to said vessel.

11. A column as claimed in claim 10 including means for hoisting vertically up and down relative to said vessel when said pivotal connection is disconnected, to allow said column to be hoisted up and down relative to said vessel.

12. A column as claimed in claim 10 including a weight distribution structure comprising at least three fold-out legs at the lowermost end thereof.

13. A column as claimed in claim 12 wherein each of said fold out legs includes a footing.

14. A column as claimed in claim 13 wherein each said footing comprises a sealable enclosure formed by a cylindrical upper cup and a cylindrical lower cup arranged one inside the other in telescoping alignment and defining a pressurable and floodable chamber therein.

15. A column as claimed in claim 14 wherein said footing includes an axial guide assembly for alignment of the cups relative to each other.

16. A column as claimed in claim 15 wherein said axial guide assembly includes a pair of members arranged to telescope along an axis co-parallel with the axial extent of said footing.

17. A column as claimed in claim 16 wherein said members include a locking device comprising a wedge driveable into an annular collar located at the junction of said members.

18. A column as claimed in claim 17 wherein said wedge is slidable along the inner member of said telescoping member and comprises a frustum bored along the axis thereof.

19. A jack-up construction comprising a vessel, and column for supporting said vessel and adapted for deployment as an offshore structure supported above the sea floor, said column having a support structure for selectively attaching to said vessel to allow said vessel to dock to and embark from said column, wherein said support structure includes a pivotal connection point for forming a pivotal connection between said column and said vessel when said column and said vessel are attached to allow said column to be rotated relative to said vessel from a horizontal stowed position to a vertical position for deployment and wherein said support structure includes a carriage adapted to traverse said column, and which may be fixed to said column to allow said column to be hoisted up and down relative to said vessel, said vessel including an element allowing for said vessel and said column to be connected to enable said vessel to dock to said column, and disconnected to enable said vessel to embark from said column.

20. A jack-up construction as claimed in claim 19 wherein said carriage includes concave shaped pulleys for guiding said column.

21. A jack-up construction as claimed in claim 19 wherein said pivotal connection extends between said carriage and said vessel.

22. A jack-up construction as claimed in claim 19 wherein said element comprises a pivoting portion on said carriage which in a closed condition secures said column for sliding movement, and restrains said column in said vertical position.

23. A jack-up construction as claimed in claim 19 including an opening located near the center of said vessel and extending vertically through the hull and deck of said vessel, through which said column is received in said vertical position, said opening extending to an edge of the vessel to accommodate said column as said column is rotated between said vertical position and said substantially horizontal stowed position.

24. A jack-up construction as claimed in claim 19 wherein said vessel includes hoisting means for moving said column vertically relative to said vessel, when said vessel is attached to said column and when said column is in said vertical position.

25. A jack-up construction as claimed in claim 19 wherein said vessel includes floodable compartments to allow balancing of the weight distribution of said vessel, relative to said column.

* * * * *